US010288282B2

(12) United States Patent
Senkyr et al.

(10) Patent No.: US 10,288,282 B2
(45) Date of Patent: May 14, 2019

(54) AIR/FUEL COMMISSIONING OF A COMBUSTION APPLIANCE

(71) Applicant: HONEYWELL INTERNATIONAL INC., Morris Plains, NJ (US)

(72) Inventors: Jiri Senkyr, Brno (CZ); Frank van Prooijen, Sleen (NL)

(73) Assignee: Honeywell International Inc., Morris Plains, NJ (US)

( * ) Notice: Subject to any disclaimer, the term of this patent is extended or adjusted under 35 U.S.C. 154(b) by 321 days.

(21) Appl. No.: 15/193,853

(22) Filed: Jun. 27, 2016

(65) Prior Publication Data

US 2017/0370577 A1 Dec. 28, 2017

(51) Int. Cl.

| | |
|---|---|
| ***F23N 1/02*** | (2006.01) |
| ***F23D 14/60*** | (2006.01) |
| ***F23N 1/00*** | (2006.01) |
| ***F23N 5/00*** | (2006.01) |
| ***F23N 5/02*** | (2006.01) |

(52) U.S. Cl.

CPC ..... *F23D 14/60* (2013.01); *F23N 1/002* (2013.01); *F23N 5/003* (2013.01); *F23N 5/02* (2013.01); *F23D 2208/005* (2013.01); *F23D 2208/10* (2013.01); *F23N 2025/30* (2013.01); *F23N 2027/20* (2013.01); *F23N 2035/14* (2013.01)

(58) Field of Classification Search

CPC ..... F23D 14/60; F23N 1/002; F23N 5/003; F23N 5/02

USPC ..... 431/1, 6, 12, 18–90

See application file for complete search history.

(56) References Cited

U.S. PATENT DOCUMENTS

| | | | | |
|---|---|---|---|---|
| 7,228,461 | B2 | 6/2007 | Krietmeyer et al. | |
| 7,455,058 | B2 | 11/2008 | Raffesberger | |
| 8,602,772 | B2 | 12/2013 | Fan et al. | |
| 9,052,708 | B2 | 6/2015 | Vishwanath et al. | |
| 2009/0158188 | A1 | 6/2009 | Bray et al. | |
| 2010/0310998 | A1* | 12/2010 | Raleigh | F23D 14/58 431/8 |

(Continued)

FOREIGN PATENT DOCUMENTS

| | | | |
|---|---|---|---|
| EP | 0124330 | A1 | 11/1984 |
| WO | 2010062286 | A1 | 6/2010 |

OTHER PUBLICATIONS

Fireye, "PPC5000 Fuel/Air Ratio Controller," 94 pages, Apr. 18, 2013.

(Continued)

*Primary Examiner* — Vivek K Shirsat

(57) ABSTRACT

A method for commissioning a gas valve assembly for controlling fuel flow to a combustion appliance. An example method for commissioning the gas valve assembly may include initiating a commissioning mode in the controller of the gas valve assembly. Once in the commissioning mode, inputting a user defined initial air to fuel (A/F) ratio, activating the combustion appliance, setting a burner load of the combustion appliance to a set burner load, inputting a desired A/F ratio for the set burner load, running the combustion appliance at the burner load with the desired A/F ratio, and observing the operation of the combustion appliance. The method may further include saving the desired A/F ratio for the set burner load to the controller of the gas valve assembly and exiting the commissioning mode.

15 Claims, 14 Drawing Sheets

(56) References Cited

U.S. PATENT DOCUMENTS

| | | | | |
|---|---|---|---|---|
| 2011/0212404 | A1* | 9/2011 | Fan | F23N 1/022 431/12 |
| 2014/0365020 | A1* | 12/2014 | Brusilovsky | G05B 19/0426 700/282 |
| 2015/0045971 | A1* | 2/2015 | Endel | G05D 7/0629 700/282 |

OTHER PUBLICATIONS

Honeywell, "S7999B System Display Commercial/Industrial Combustion Controls," 4 pages, May 2007.
Honeywell, "S7999B System Display, Product Data," 76 pages, Apr. 2006.
Honeywell, "S7999D1048 Combustion System Operator Interface Display, Product Data," 76 pages, Aug. 2012.
Honeywell, "ZM7999 ControLinks Software Configuration Tool, User's Manual," 32 pages, Dec. 2004.
The International Search Report and Written Opinion for PCT Application No. PCT/US2017/039296 dated Sep. 11, 2017.

* cited by examiner

AIR/FUEL COMMISSIONING OF A COMBUSTION APPLIANCE

TECHNICAL FIELD

The present disclosure relates generally to systems and methods for defining an air/fuel ratio for a burner of a combustion appliance, and more particularly to defining an air/fuel curve versus burner load for a burner of a combustion appliance.

BACKGROUND

The air/fuel ratio used during the operation of a combustion appliance can affect the efficiency and emissions of the combustion appliance. Examples of such combustion appliances include furnaces, water heaters, boilers, direct/indirect make-up air heaters, power/jet burners and any other residential, commercial or industrial combustion appliance. In many cases, a combustion appliance can be modulated over a plurality of burner loads, with each burner load resulting in a different heat output. At higher burner loads, more fuel and more air are provided to the burner, and at lower burner loads less fuel and less air are provided to the burner.

In many cases, the combustion appliance may include a burner that is fed air by a modulating blower or the like and fuel is fed by a modulating gas valve. The modulating gas valve may have an air/fuel controller that is designed to control the air/fuel ratio that is delivered to the burner. In some cases, the air/fuel controller may not have direct control over the burner load of the combustion appliance. Instead, the air/fuel controller may be a slave device and simply receive a burner load command from an external controller, and may respond by modulating the gas valve to provide a desired air/fuel ratio to the burner at the commanded burner load. For increased efficiency and/or reduced emissions, the air/fuel ratio may be set higher at lower burner loads and lower at higher burner loads.

In many cases, an air/fuel ratio versus burner load curve is set during a commissioning process of the gas valve at the time of installation or during subsequent maintenance. The particular air/fuel ratio versus burner load curve may depend on the particular equipment involved and/or the particular application at hand. Air/fuel ratio curve versus burner load curve commissioning can be a time consuming and tedious process, especially when the air/fuel controller does not control the burner load of the combustion appliance. What would be desirable are improved methods and systems for commissioning an air/fuel curve of a combustion appliance.

SUMMARY

The present disclosure relates generally to systems and methods for defining an air/fuel ratio for a burner of a combustion appliance, and more particularly to defining an air/fuel curve versus burner load for a burner of a combustion appliance.

In one example, a method may include commissioning a gas valve assembly for controlling fuel flow to a combustion appliance. The gas valve assembly may include a valve body with an inlet port and an outlet port, and a fluid path extending between the inlet port and the outlet port. The gas valve assembly may further include at least one valve situated in the fluid path between the inlet port and the outlet port and a controller secured relative to the valve body and in communication with the at least one valve. The controller may be configured to move the at least one valve between an open configuration, a closed configuration, and a plurality of intermediate configurations therebetween to control a flow of gas to a gas burner of the combustion appliance. The method for commissioning a gas valve assembly may include initiating a commissioning mode in the controller of the gas valve assembly. Once in the commissioning mode, the method may comprise inputting a user defined initial air to fuel (A/F) ratio, activating the combustion appliance, setting a burner load of the combustion appliance to a set burner load, inputting a desired A/F ratio for the set burner load, running the combustion appliance at the burner load with the desired A/F ratio, and observing the operation of the combustion appliance. The method may further include saving the desired A/F ratio for the set burner load to the controller of the gas valve assembly and exiting the commissioning mode.

In another example, a method may include commissioning a gas valve assembly for controlling fuel flow to a combustion appliance. The gas valve assembly may include a valve body with an inlet port and an outlet port, and a fluid path extending between the inlet port and the outlet port. The gas valve assembly may further include at least one valve situated in the fluid path between the inlet port and the outlet port and a controller secured relative to the valve body and in communication with the at least one valve. The controller may be configured to move the at least one valve between an open configuration, a closed configuration, and a plurality of intermediate configurations therebetween to control a flow of gas to a gas burner of the combustion appliance. The method for commissioning the gas valve may comprise activating the combustion appliance, setting a burner load of the combustion appliance to a first set burner load, entering two or more A/F ratios for the first set burner load, running the combustion appliance at each of the entered A/F ratios at the first set burner load, and observing the operation of the combustion appliance to identify a desired A/F ratio for the first set burner load. The method may further comprise saving the desired A/F ratio for the first set burner load to the controller of the gas valve assembly and repeating in order to save a plurality of desired A/F ratios one for each of a plurality of different burner loads that are between a minimum burner load and a maximum burner load of the combustion appliance.

In another example, a gas valve assembly for controlling fuel flow to a combustion appliance may comprise a valve body with an inlet port and an outlet port, and a fluid path extending between the inlet port and the outlet port. At least one valve may be situated in the fluid path between the inlet port and the outlet port. A controller may be secured relative to the valve body and in communication with the at least one valve. The controller may be configured to move the at least one valve between an open configuration, a closed configuration, and a plurality of intermediate configurations therebetween to control a flow of gas to a gas burner of the combustion appliance. A user interface may be operatively coupled to the controller and configured to receive a plurality of desired A/F ratios one for each of a plurality of different burner loads between a minimum burner load and a maximum burner load of the combustion appliance. The controller may be configured to receive a desired burner load as an input, and to move the at least one valve to control the flow of gas to the gas burner in accordance with the desired A/F ratio at the desired burner load.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments in connection with the accompanying drawings, in which.

Figure 1:
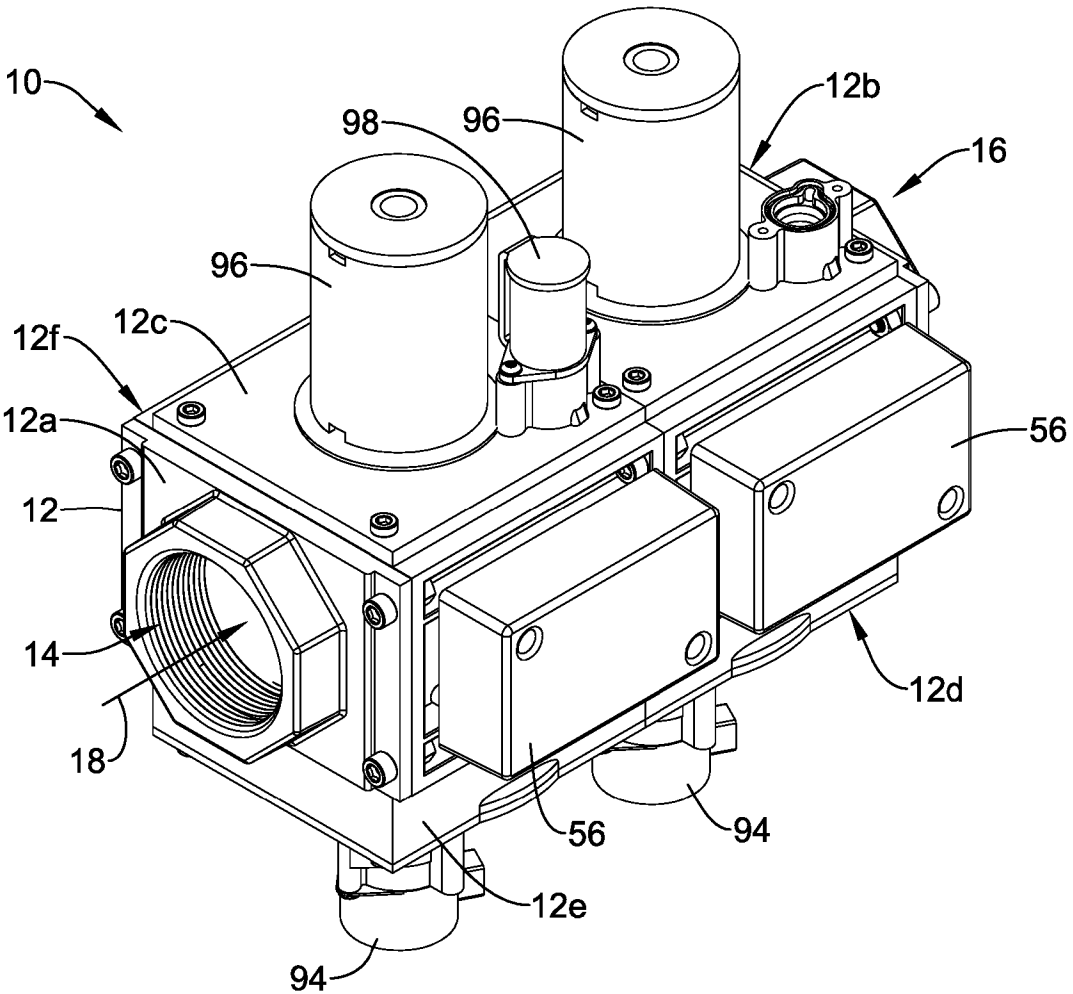
FIG. 1 is a schematic perspective view of an illustrative gas valve assembly.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The detailed description and drawings show several illustrative embodiments which are meant to be illustrative of the claimed disclosure.

Gas valves may be added to supply fuel to a burner of a combustion appliances. An air to fuel ratio curve (also referred to as air/fuel curve, A/F curve, and/or A/F ratio curve) may define a dependency of the air/fuel ratio on burner load. The A/F ratio may affect the burner efficiency and/or burner emissions differently at different burner loads. In some cases, an air/fuel ratio curve may be used to define a desired A/F ratio for each of a plurality of burner loads. In heating (and/or other fuel burning) applications, an air/fuel curve may be used to optimally control lambda (e.g. the ratio of the actual air/fuel ratio to the stoichiometric ratio) over the entire burner load range of the system in order to achieve low emissions of COx, NOx and/or to increase efficiency (e.g. save fuel). In order to meet the requirements of each application, an air/fuel curve may need to be set (e.g. commissioned) upon installation of the gas valve by an installer.

In some cases, a gas valve assembly may be configured to monitor and/or control various operations including, but not limited to, gas flow and/or gas consumption, electronic cycle counting, overpressure diagnostics, high gas pressure and low gas pressure detection, valve proving system tests, valve leakage tests, proof of valve closure tests, diagnostic communications, and/or any other suitable operation as desired. In addition, a gas valve assembly may be configured to facilitate A/F curve commissioning, as further described below.

FIG. 1 is a schematic perspective view of an illustrative valve assembly 10 for controlling gas flow to a combustion appliance or other similar or different device. In the illustrative embodiment, the gas valve assembly 10 may include a valve body 12, which may generally be a six sided shape or may take on any other shape as desired, and may be formed as a single body or may be multiple pieces connected together. As shown, valve body 12 may be a six-sided shape having a first end 12*a*, a second end 12*b*, a top 12*c*, a bottom 12*d*, a back 12*e* and a front 12*f*, as depicted in the various views of FIGS. 1-2. The terms top, bottom, back, front, left, and right are relative terms used merely to aid in discussing the drawings, and are not meant to be limiting in any manner.

The illustrative valve body 12 includes an inlet port 14, an outlet port 16 and a fluid path or fluid channel 18 extending between the inlet port 14 and the outlet port 16. Further, the valve body 12 may include one or more gas valve ports 20 (e.g., a first valve port 20*a* and a second valve port 20*b*, shown in FIG. 3) positioned or situated in the fluid channel 18, one or more fuel or gas valve member(s) (sometimes referred to as valve sealing member(s)) moveable within the gas valve ports 20 (e.g., a first valve sealing member within the first valve port 20*a* and a second valve sealing member within the second valve port 20*b*, though not explicitly shown), one or more pressure sensor assemblies 24 (as shown in FIG. 3, for example), one or more position sensors (not explicitly shown), and/or one or more valve controllers 26 (as shown in FIG. 3, for example) affixed relative to or coupled to the valve body 12 and/or in electrical communication (e.g., through a wired or wireless connection) with pressure sensor assemblies 24, position sensor(s), and gas valve members.

The valve assembly 10 may further include one or more actuators for operating moving parts therein. For example, valve assembly 10 may have actuators including, but not limited to, one or more stepper motors 94 (shown as extending downward from the bottom 12*d* of valve body 12 in FIG. 1), one or more solenoids 96 (shown as extending upward from the top 12*c* of valve body 12 in FIG. 1), and one or more servo valves 98 (a servo valve 98 is shown as extending upward from the top 12*c* of valve body 12 in FIG. 1-2, where a second servo valve has been omitted), where the servo valve 98 may be a 3-way auto-servo valve or may be any other type of servo valve. In one illustrative embodiment, the one or more solenoids 96 control whether the one or more gas valve ports 20 are open or closed. The one or more stepper motors 94 determine the opening size of the gas valve ports 20 when the corresponding gas valve sealing member is opened by the corresponding solenoid 96. Of course, the one or more stepper motors 94 would not be provided when, for example, the valve assembly 10 is not a "modulating" valve that allows more than one selectable flow rate to flow through the valve when the valve is open. The one or more actuators and/or motors 94, 96, 98 may be in electrical communication (e.g., through a wired or wireless connection) with the one or more valve controllers 26.

Figure 2:
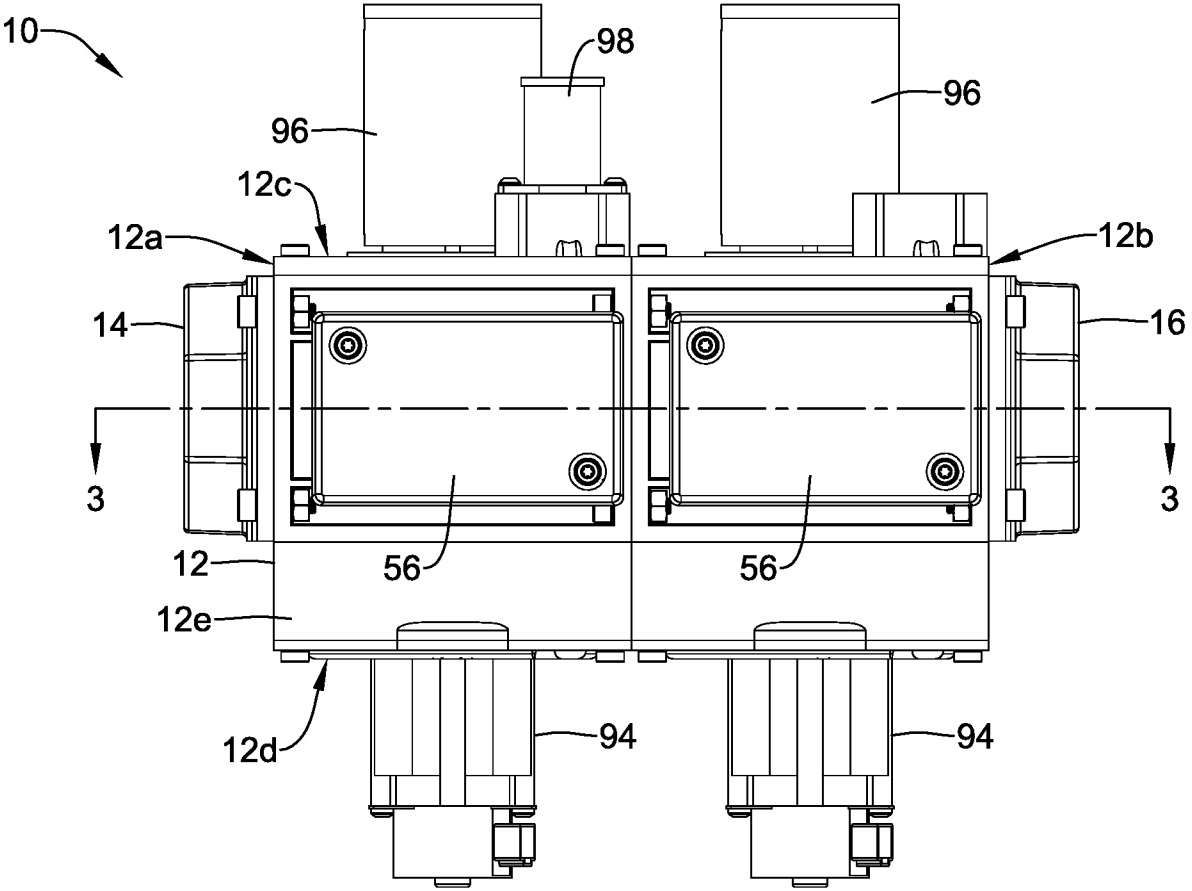
FIG. 2 is a schematic side view of the illustrative gas valve assembly of FIG. 1.

As shown, the valve body 12 may include one or more sensor and electronics compartments 56, which in the illustrative embodiment, extend from the back side 12*e* as depicted in FIGS. 1-2. The sensor and electronics compartments 56 may be coupled to or may be formed integrally with the valve body 12, and may enclose and/or contain at least a portion of the valve controllers 26, pressure sensors assemblies 24 and/or electronics required for operation of valve assembly 10 as described herein. Although the compartments 56 may be illustratively depicted as separate structures, the compartments 56 may be a single structure part of, extending from, and/or coupled to the valve body 12.

Figure 3:
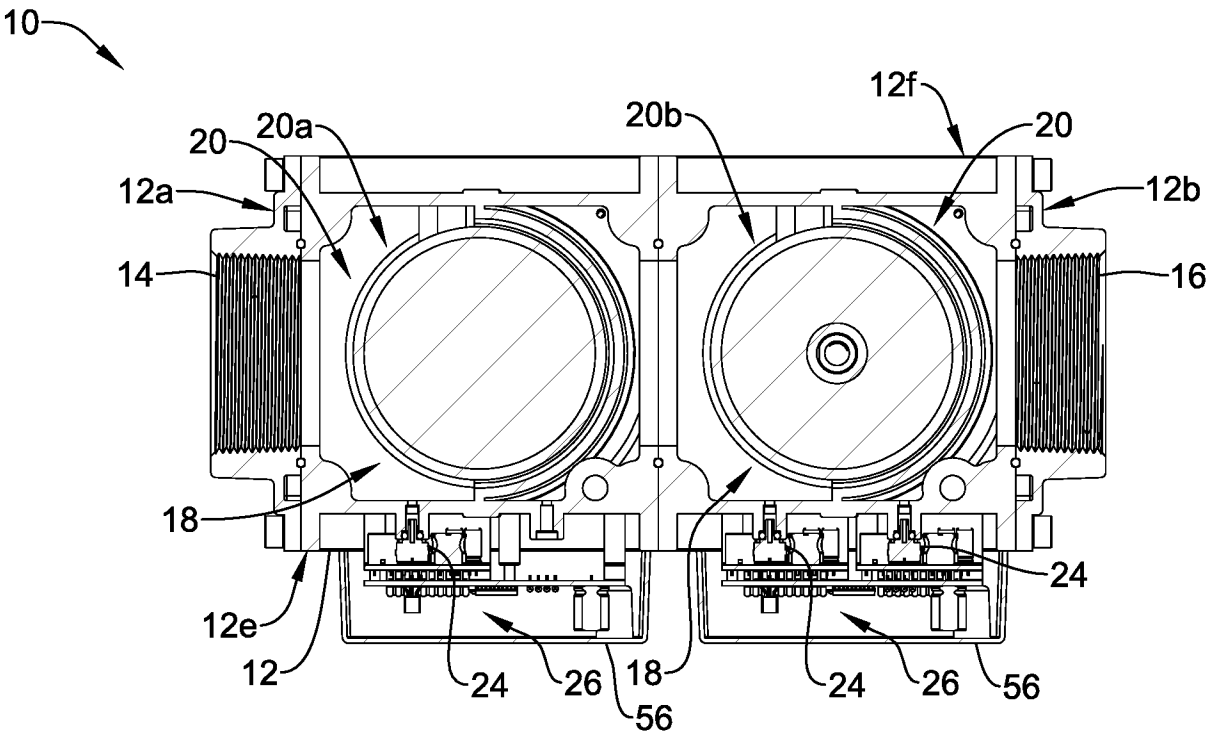
FIG. 3 is a cross-sectional view of the illustrative gas valve assembly of FIG. 1, taken along line 3-3 of FIG. 2.

FIG. 3 illustrates a cross-sectional view of the illustrative valve 10 taken at line 3-3 in FIG. 2. In the illustrative embodiment, the one or more fluid valve ports 20 may include a first gas valve port 20*a* and a second gas valve port 20*b* situated along and/or in communication with the fluid channel 18. This is a double-block valve design. Within each gas valve port 20, a gas valve sealing member may be situated in the fluid channel 18 and may be positioned (e.g., concentrically or otherwise) about an axis, rotatable about the axis, longitudinally and axially translatable, rotationally translatable, and/or otherwise selectively movable between a first position (e.g., an open or closed position) and a second position (e.g., a closed or open position) within the corresponding valve port 20. Movement of the valve sealing member may open and close the valve port 20.

It is contemplated that the valve sealing member may include one or more of a valve disk, a valve stem and/or valve seal for sealing against a valve seat situated in the fluid channel 18 and/or other similar or dissimilar components facilitating a seal. Alternatively, or in addition, the valve sealing member may include structural features and/or components of a gate valve, a disk-on-seat valve, a ball valve, a butterfly valve and/or any other type of valve configured to operate from a closed position to an open position and back to a closed position. An open position of a valve sealing member may be any position that allows fluid to flow through the respective gas valve port 20 in which the valve sealing member is situated, and a closed position may be when the valve sealing member forms at least a partial seal at the respective valve port 20. The valve sealing member may be operated through any technique. For example, the valve sealing member may be operated through utilizing a spring, an actuator to effect movement against the spring, and, in some cases, a position sensor to sense a position of the valve sealing member.

The valve actuator(s) may be any type of actuator configured to operate valve sealing member by actuating valve sealing member from the closed position to an open position and then back to the closed position during each of a plurality of operation cycles during a lifetime of the gas valve assembly 10 or of actuator. In some cases, valve actuator may be a solenoid actuator (e.g., a first valve actuator and a second valve actuator), a hydraulic actuator, magnetic actuators, electric motors, pneumatic actuators, and/or other similar or different types of actuators, as desired. While not explicitly shown, the valve actuators may be configured to selectively move the valves or valve sealing members of the valve ports 20*a*, 20*b* between a closed position, which closes the fluid channel 18 between the inlet port 14 and the outlet port 16 of the valve body 12, and an open position. The gas valve assembly of FIGS. 1-3 is an example of a gas safety shutoff valve, or double-block valve. In some cases, however, it is contemplated that the gas valve assembly 10 may have a single valve sealing member, or three or more valve sealing members in series or parallel, as desired.

In some cases, the valve assembly 10 may include a characterized port defined between the inlet port 14 and the outlet port 16. A characterized port may be any port (e.g., a fluid valve port 20 or other port or restriction through which the fluid channel 18 may travel) at or across which an analysis may be performed on a fluid flowing therethrough. For example, if a flow resistance of a valve port 20 is known over a range of travel of the valve sealing member, the one of the one or more gas valve ports 20 may be considered the characterized port. As such, and in some cases, the characterized port may be a port 20 having the valve sealing member configured to be in an open position and in a closed position. Alternatively, or in addition, a characterized port may not correspond to a gas valve port 20 having a valve sealing member. Rather, the characterized port may be any constriction or feature across which a pressure drop may be measured and/or a flow rate may be determined.

Figure 4:
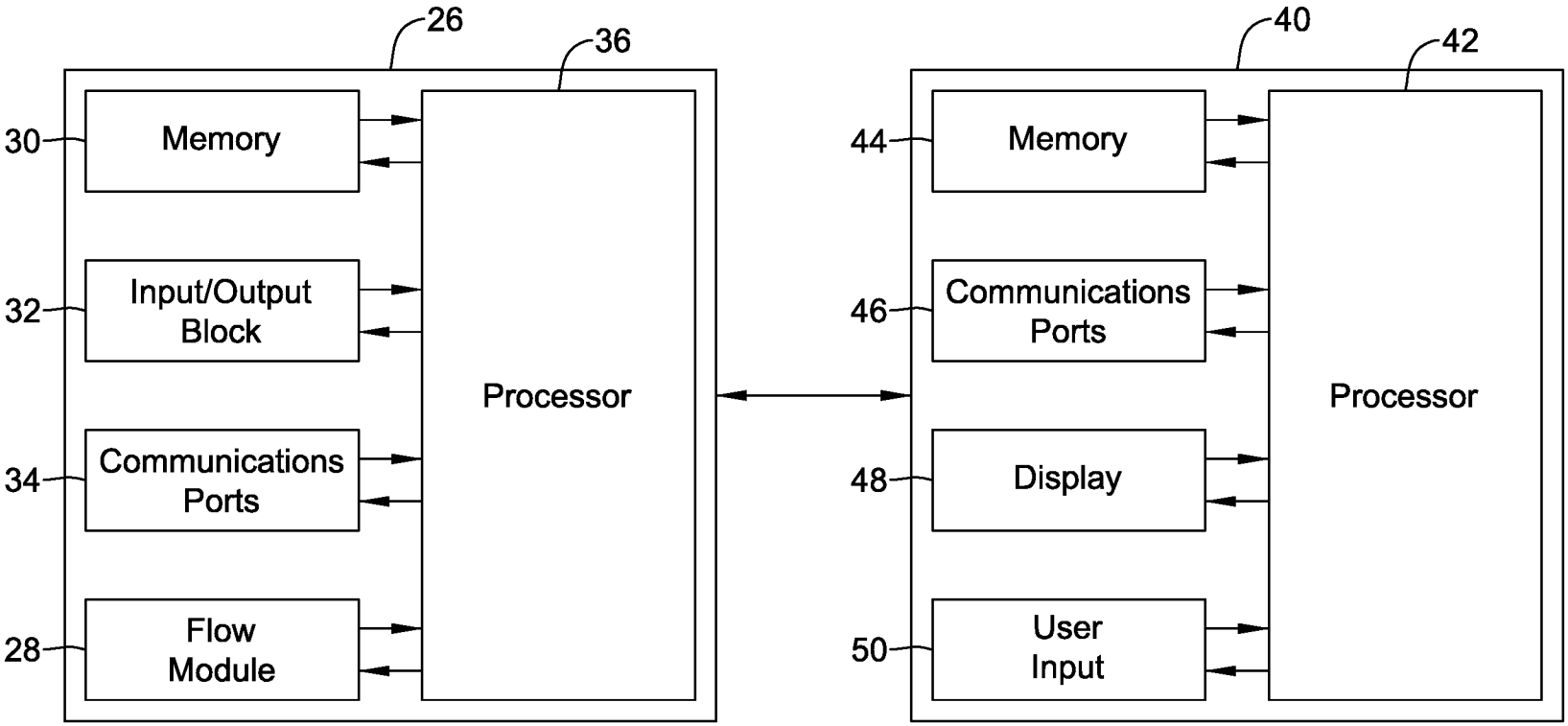
FIG. 4 is a schematic block diagram of an illustrative valve controller in communication with an illustrative external device.

In some cases, the gas valve assembly 10 may include a flow module 28 (see, for example, FIG. 4) for sensing one or more parameters of a fluid flowing through fluid channel 18, and in some cases, determining a measure related to a gas flow rate of the fluid through the fluid channel 18. In some instances, the flow module 28 may include a pressure block or pressure sensor assembly 24, a temperature sensor, a valve member position sensor and/or a valve controller 26, among other assemblies, sensors and systems for sensing, monitoring and/or analyzing parameters of a fluid flowing through fluid channel 18. Alternatively, or additionally, the flow module 28 may be a part of the valve controller 26, as shown in FIG. 4.

It is contemplated that the flow module 28 may utilize any type of sensor to facilitate determining a measure related to a flow rate of a fluid through the fluid channel 18, such a pressure sensor, a flow sensor, a valve position sensor, and/or any other type of sensor, as desired. In one example, the flow module 28, which in some cases may be part of a valve controller 26, may be configured to monitor a differential pressure across a characterized port, and in some cases, a position of one or more valve sealing members 22 of the gas valve assembly 10. The information from monitoring may be utilized by the flow module 28 to determine and monitor the flow rate of fluid (liquid or gas) passing through the fluid channel 18. In some cases, the flow module 28 may determine a measure that is related to a gas flow rate through the fluid channel 18 based, at least in part, on the measure that is related to the pressure drop across the characterized port along with the pre-stored relationship in the memory 30. The memory may be a part of the valve controller 26 or more specifically part of the flow module 28, as desired. Additionally, the flow module 28 may further determine a relationship between a desired burner load (e.g. firing rate) and the measure related to a gas flow rate based, at least in part, on a previously established relationship stored in the memory 30. In some cases, the previously established relationship may include A/F versus burner load curve.

The different relationships described herein may be generated during installation and/or calibration of the valve assembly 10, and may be stored as data tables or curves in the memory 30. Using the previously established relationship(s) between flow rate and burner load (e.g. firing rate) and a burner load control signal or command received at the valve assembly 10 from another device (e.g. building controller, system level controller or combustion appliance controller) within the system, the flow module 28 may be configured to determine a measure of fuel flow through the valve assembly 10 to achieve a desired A/F ratio. Thus, the flow module 28 may be consider an air/fuel controller, which may be part of the valve assembly 10.

In some instances, the flow module 28 may further be configured to determine a measure of cumulative fuel flow through the fluid channel 18 over a predetermined period of time. Additionally, or alternatively, the flow module 28 may be configured to determine a measure of instantaneous fuel flow through the fluid channel 18 in real time. Cumulative fuel consumption and/or instantaneous fuel consumption may be calculated from the fuel flow based, at least in part, on the Wobbe Index associated with the fluid flowing through the fluid channel 18, which also may be stored in the memory 30 of the valve assembly 10.

It is contemplated that electronic valve controller or valve control block 26 (see, FIG. 3) may be physically secured or coupled to, or secured or coupled relative to, valve body 12. The valve controller 26 may be configured to control and/or monitor a position or state (e.g., an open position and a closed position) of the valve sealing members of the valve ports 20 and/or to perform other functions and analyses, as desired. In some cases, the valve control block 26 may be configured to close or open gas valve member(s) or valve sealing member(s) on its own volition, in response to control signals or commands from other systems or appliances (e.g., a system level controller, central building controller, or combustion appliance controller), and/or in response to received measures related to sensed pressures upstream, intermediate, and/or downstream of the characterized valve port(s), measures related to a sensed differential pressure across the characterized valve port(s), measures related to temperature sensed upstream, intermediate, and/or downstream of the characterized valve port(s), and/or in response to other measures, as desired. In one example, the valve control block 26 may be configured to close or open gas valve member(s) or the valve sealing member(s) in response to receiving a burner load (e.g. firing rate) control signal or command from a system or building level controller or an appliance controller (e.g. burner controller) to control a rate of flow of gas through the valve assembly 18 and to a connected appliance to achieve a desired A/F ratio for the commanded burner load.

The memory 30, which in some cases may be part of valve controller 26, may be configured to record data related to sensed pressures, sensed differential pressures, sensed temperatures, and/or other measures. The valve controller 26 may access this data, and in some cases, communicate (e.g., through a wired or wireless communication link) the data and/or analyses of the data to other systems (e.g., a system level or central building control). The memory 30 and/or other memory may be programmed and/or developed to contain software to affect one or more of the configurations described herein.

FIG. 4 is a schematic block diagram of an illustrative valve controller 26. The illustrative valve controller 26 includes a processor or controller 36. The controller 26 may be adapted or configured to operate in accordance with an algorithm that controls or at least partially controls portions of the valve assembly 10. The valve controller 26 may include a memory block 30 that may be considered as being electrically connected to the processor 36. The memory block 30 may be used to store any desired information, such as the aforementioned control algorithm, set points, A/F ratio versus burner load curves, and the like. The processor 36 may store information within memory block 30 and may subsequently retrieved the stored information. The memory block 30 may be any suitable type of storage device, such as RAM, ROM, EPROM, a flash drive, a hard drive, and the like.

In many cases, the valve controller 26 may include an input/output block (I/O block) 32 having a number of wire terminals for receiving one or more wires from the valve assembly 10 and/or combustion appliance. Also, while the term I/O may imply both input and output, it is intended to include input only, output only, as well as both input and output. The I/O block 32 may be used to communicate one or more signals to and/or from the valve assembly 10 and/or combustion appliance. The valve controller 26 may have any number of wire terminals for accepting connections from the valve assembly 10 and/or combustion appliance. How many and which of the wire terminals are actually used at a particular installation will depend on the particular configuration of the valve assembly 10 and/or combustion appliance.

In some cases, as illustrated, the valve controller 26 may include a communications or data port 34. The communication ports 34 may be configured to communicate with the processor 36 and may, if desired, be used to either upload information to the processor 36, download information from the processor 36, provide commands to the processor 36, send commands from the processor 36, and/or perform any other suitable task. The communication port 34 may be a wireless port such as a Bluetooth™ port or any other wireless protocol. In some cases, communication port 34 may be a wired port such as a serial port, a parallel port, a CATS port, a USB (universal serial bus) port, or the like. In some instances, the communication port 34 may be a USB port and may be used to download and/or upload information from a USB flash drive. Other storage devices may also be employed, as desired. In some cases, a separate device 40 may be in communication with the processor 36 of the valve controller 26 to facilitate calibration procedures.

As noted above, the valve controller 26 may be in wired or wireless communication with an external device 40. The external device 40 may be a computing device separate from the valve assembly 10. For example, the external device 40 may be a personal computer, tablet computer, smart phone, laptop computer, or other computer as desired. In some cases, the external device 40 may not be a part of the valve assembly 10 or combustion appliance. For example, the external device 40 may be a portable device which travels with the installer. The external device 40 may be adapted or configured to commission a valve assembly 10 and/or generate an A/F curve for a particular valve assembly 10 and combustion appliance set up using a commissioning wizard or software program to facilitate commissioning of the valve assembly 10. The external device 40 may include a processor and a memory block 44 connected to the processor 42. The memory block 44 may be used to store any desired information, such as the aforementioned commissioning wizard, software programs, and the like. The processor 42 may store information within memory block 44 and may subsequently retrieved the stored information. The memory block 44 may be any suitable type of storage device, such as RAM, ROM, EPROM, a flash drive, a hard drive, and the like.

In some cases, as illustrated, the external device 40 may include a communications or data port 46. The communication ports 46 may be configured to communicate with the processor 42 and may, if desired, be used to either upload information to the processor 42, download information from the processor 42, provide commands to the processor 36, send commands from the processor 36, and/or perform any other suitable task. The communication port 46 may be a wireless port such as a Bluetooth™ port or any other wireless protocol. In some cases, communication port 46 may be a wired port such as a serial port, a parallel port, a CAT5 port, a USB (universal serial bus) port, or the like. In some instances, the communication port 46 may be a USB port and may be used to download and/or upload information from a USB flash drive. Other storage devices may also be employed, as desired. In some cases, the external device 40 may be in communication with the processor 36 of the valve controller 26 to facilitate calibration procedures.

The external device 40 may also include a display 48. The display 48 may be part of a personal computer, tablet computer, smart phone, laptop computer, or may include a standalone display. In some instances, the external device 40 may include a user input 50 for receiving a user input from a user. For example, the user input may include a keyboard, mouse, actuatable buttons, or a touchscreen display. These are just examples.

Figure 5:
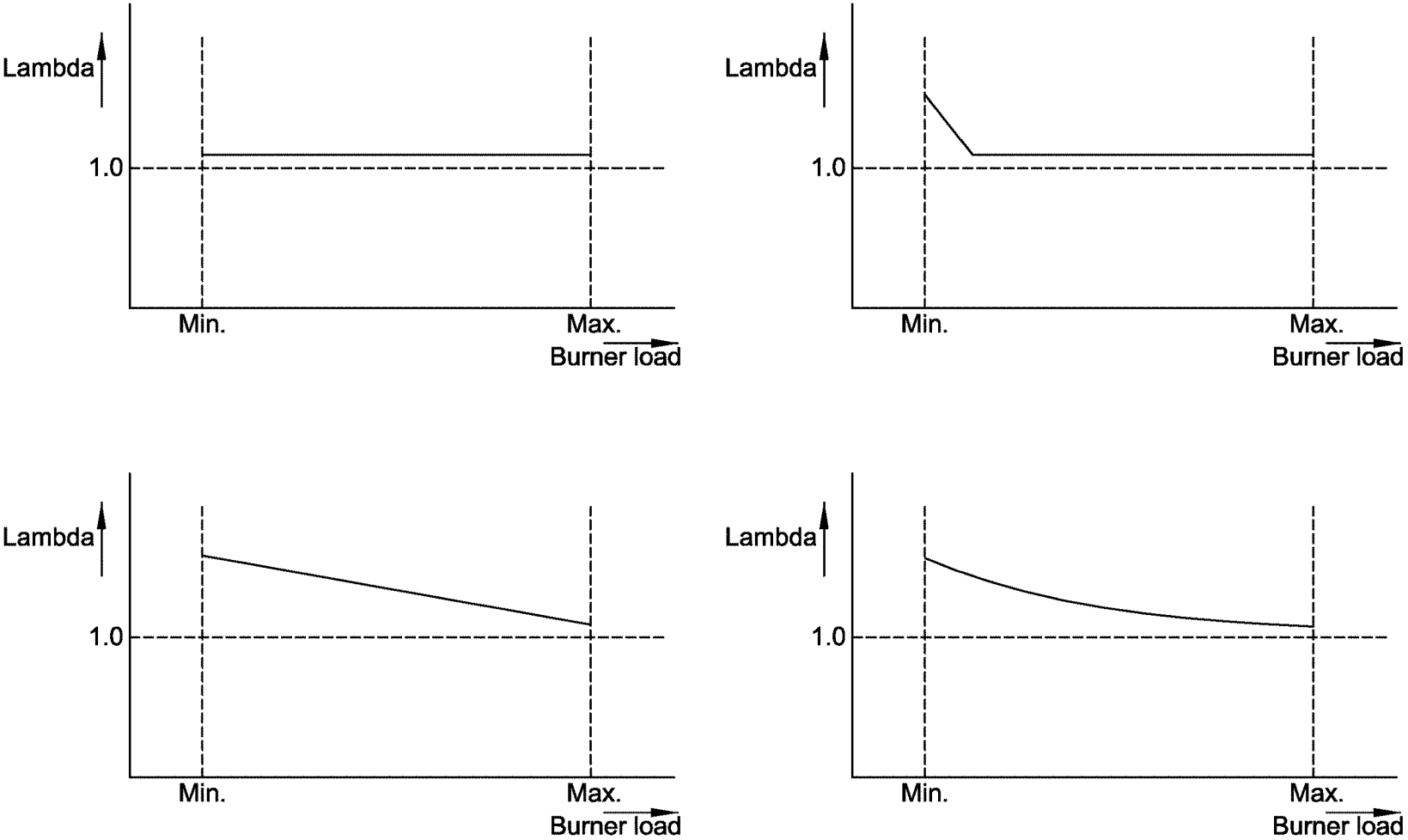
FIG. 5 shows illustrative air to fuel ratio versus burner load curves.

As described above, an air to fuel ratio curve may define a dependency of the air/fuel ratio on burner load. The optimum A/F ratio to minimize burner emissions may change depending on the burner load of the combustion appliance. An air/fuel ratio curve may be used to define the appropriate A/F ratio for a given burner load. In heating (and/or other fuel burning) applications, an air/fuel curve may be used to control lambda (e.g. the ratio of the actual air/fuel ratio to the stoichiometric ratio) over the entire operating range (burner load range) of the system in order to achieve low emissions of COx, NOx and/or to achieve high efficiency (e.g. save gas). Some illustrative A/F ratio curves are shown in FIG. 5. These example curves are not meant to be limiting, but rather, to be illustrative of some different curves that may be suitable. In order to meet the requirements of each application, an air/fuel curve may need to be customized and set (e.g. commissioned) upon installation of the gas valve by an installer. The appropriate A/F curve may depend on several factors, such as a type of an appliance (premix, power-jet etc.), fuel type, the particular application at hand, and others. The process of setting up the A/F curve for a particular installation may be considered part of the "commissioning" process, and is often performed by trained personnel.

Figure 6:
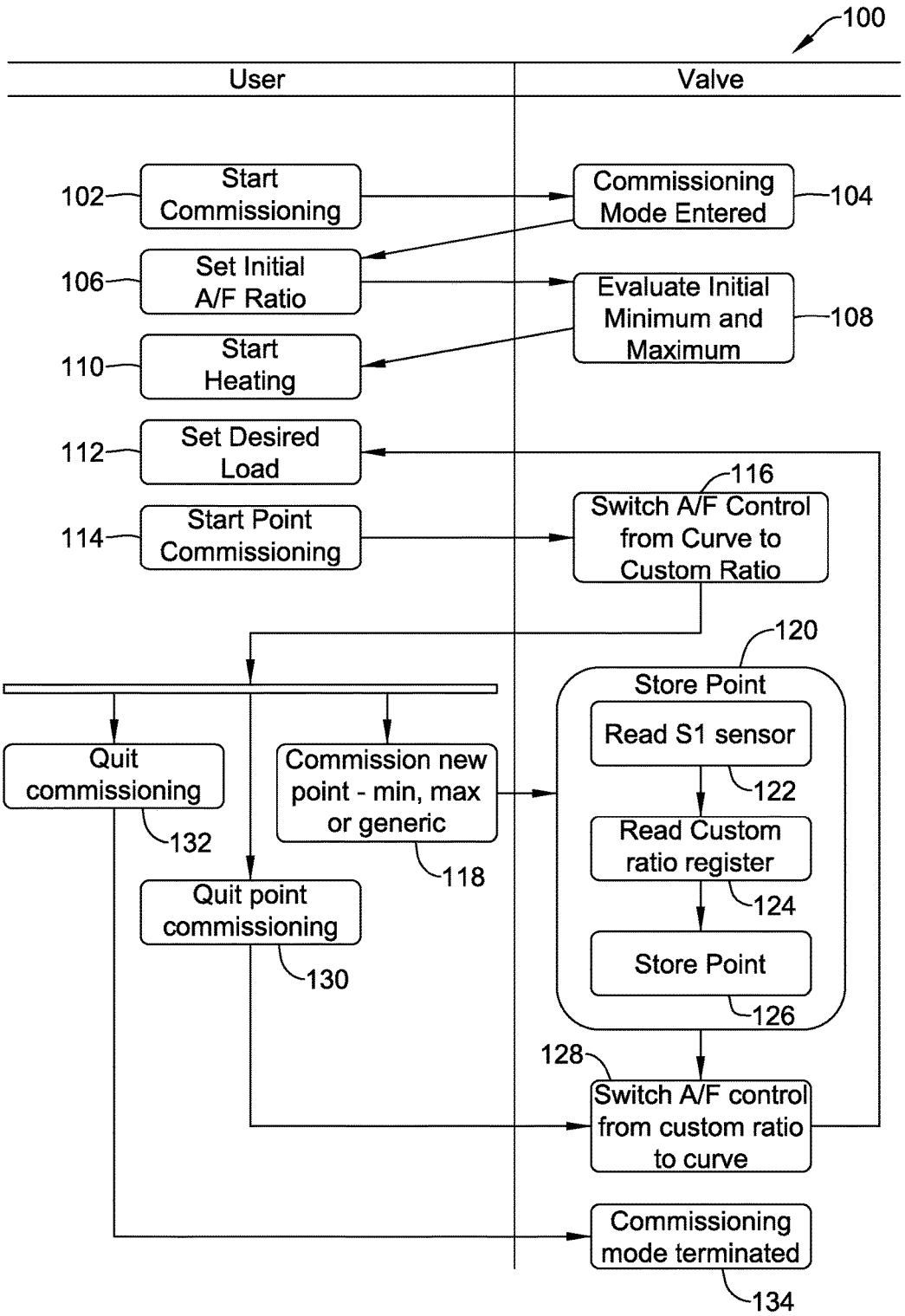
FIG. 6 is a schematic diagram showing an example commissioning procedure for a gas valve assembly.

FIG. 6 is schematic flow chart of an illustrative method 100 for commissioning a gas valve assembly 10. To begin, the user (e.g. trained personnel) may start the commissioning procedure, as shown at block 102. As described above, the external device 40 may include a commissioning wizard which may guide the user through the commissioning procedure. The wizard may show and/or hide actions that are permitted and/or banned at a given commissioning stage to facilitate the process. For example, banned actions may be grayed out or otherwise made un-selectable. For clarity, banned actions in the Figures are illustrated as having a dashed perimeter. The user may use the display 48 of the external device 40 to view information related to the commissioning procedure and use the user input 50 to provide information to the external device 40, which then relays the information to the valve controller 26. In the case of a touchscreen device, the display 48 and the user input 50 may be the same component (e.g. touchscreen display).

The external device 40 may be connected to the valve controller 26 through a wireless or wired connection. The user may initiate the commissioning wizard as shown at 102 through the actuation of a button, key, etc. using the external device 40. The external device 40 may relay a command (e.g. Modbus command) to the valve controller 26 to enter a commissioning or installer mode, as shown at block 104. The commissioning mode may or may not be password protected, as desired. Prior to commissioning, the valve controller 26 may perform system checks to verify the valve assembly 10 is working properly and determine whether the valve assembly 10 is properly configured. These system checks may include, but are not limited to, verifying that no errors have been reported such as malfunction of the electronics, the A/F hardware components (A/F module) is connected, and/or the valve controller 26 is configured to allow A/F ratio control. These are just examples. Other system checks can be performed, as desired.

Once the valve controller 26 has received the start commissioning command, the behavior of the valve system may be altered during the commissioning process. For example, errors of A/F curve minimum and maximum may be ignored to allow their setup. A user can quit the commissioning process at any time by sending an appropriate Modbus command from the external device 40 to the valve controller 26.

Figure 7:
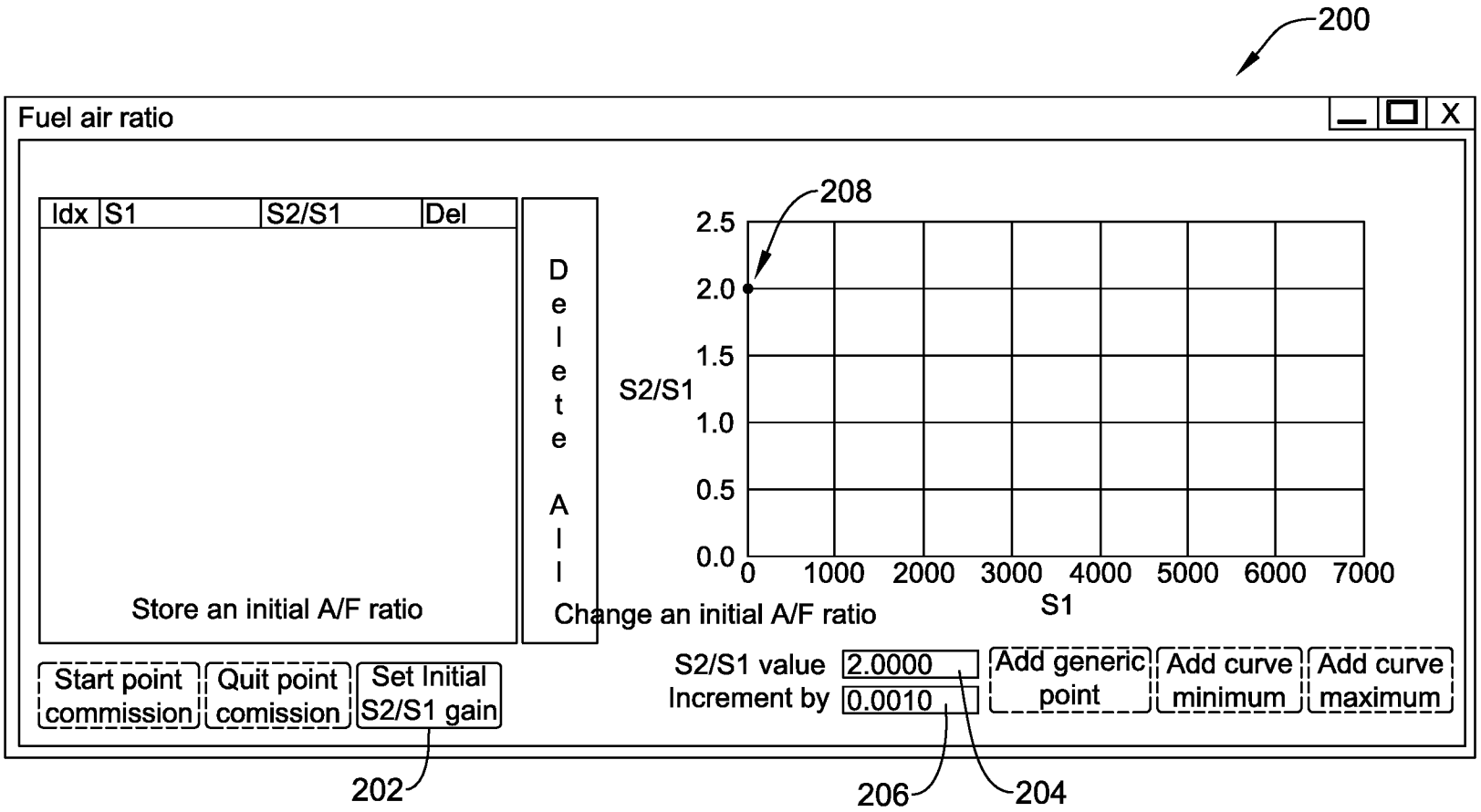
FIGS. 7-11 are screenshots of an illustrative commissioning wizard.

Once the valve controller 26 is in the commissioning mode, the user may set an initial air/fuel ratio (e.g. an initial A/F ratio), as shown at block 106. Referring additionally to FIG. 7, which shows an illustrative screenshot 200 from an example valve commissioning wizard prior to the user defining an initial A/F ratio. The user may select a button 202 to set the initial A/F ratio. As can be seen in the screenshot 200, banned actions (e.g. buttons) may be grayed out to ease the commissioning process for the user. The selectable button 202 may include verbiage which aids the user in the selection. It should be understood that the screenshot is merely illustrative. Further, it should be understood that in the screenshot "S2/S1" is used to denote the air to fuel ratio, where "S1" is proportional to an amount of air supplied to the burner and is representative of the burner load of the combustion appliance. Once the set initial A/F ratio button 202 has been selected, the user may enter the initial A/F ratio at location 204 in the example wizard screen. The user may also select an increment 206 at which the A/F ratio will be changed during the commissioning process. Once the initial A/F value has been entered or input, the value may appear on the A/F ratio curve, as shown at 208. In some cases, the initial A/F ratio 204 may only be set and/or changed when there has not been a custom A/F curve point defined. The various screenshots used herein should be understood to be merely illustrative. The values and/or captions included in the screenshots are not intended to be limiting.

The initial A/F ratio (e.g. initial A/F ratio) may need to be set before the valve controller 26 is allowed to initially fire the burner. If an error is reported, the valve controller 26 may dwell in a lockout state. If no initial A/F ratio is defined, the valve controller 26 may enter and stay in the lockout and prevent the burner from being fired. This may be considered a safety feature that prevents the burner from being fired at an unsafe A/F ratio.

Figure 8:
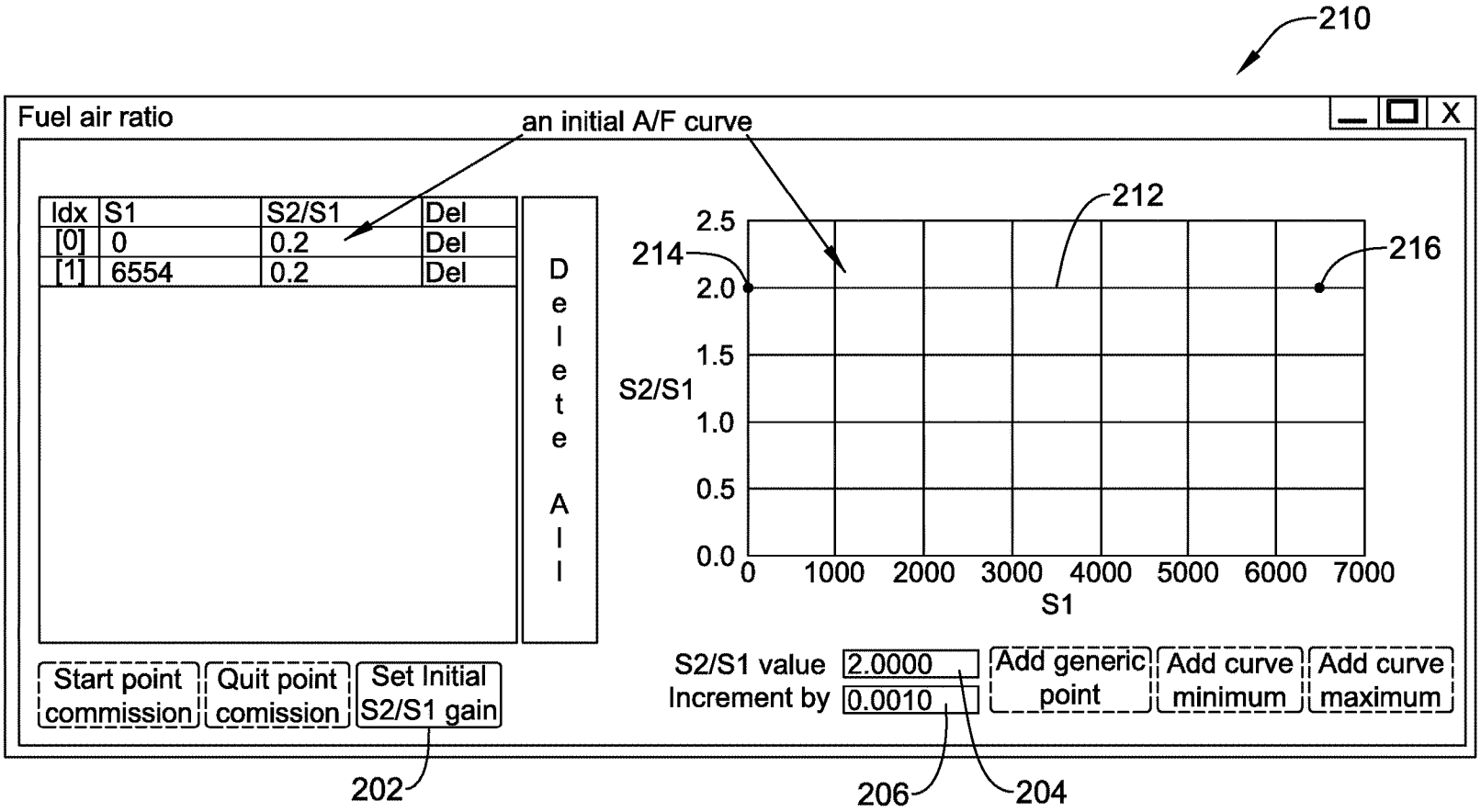

Once an initial A/F ratio is defined, the valve controller 26 may leave the lockout state and may help a user setup an initial A/F curve. In some instances, the two points may be initially entered, corresponding to a minimum burner load and a maximum burner load, although this is not required. FIG. 8 illustrates a screenshot 210 of the illustrative wizard after the user entered an initial or minimum A/F ratio of "0.2" at a zero burner load (S1), and a maximum A/F/ratio of "0.2" at a burner load (S1) of "6554". The initial minimum 214 and maximum 216 A/F ratios define an initial A/F curve 212, shown as a horizontal line in FIG. 8. The initial A/F curve 212 may be temporary and may need to be redefined and/or modified by a user to a custom minimum and maximum A/F ratio and in some cases one or more intermediate points. The valve controller 26 may evaluate the initial minimum and maximum valve to determine if they are present, as shown at block 108.

In the example shown, once the initial A/F curve has been generated, the user may activate the burner of the appliance, as shown at block 110. In the case of a gas fired heater, this may include activating the burner to start heating. In some instances, the combustion appliance may be activated and the burner load set via a user interface of the combustion appliance. The user interface of the combustion appliance may be separate from either or both of the external device 40 and/or the gas valve assembly 10. Activation of the gas fired appliance may insure that the gas valve assembly 10 is opened and gas is burning. This may require an installer who is commissioning the curve to actually operate the burner such that the installer has an immediate feedback on quality of combustion. It may help prevent an incorrect setting of the A/F curve, which could result if the A/F curve is set "offline" (when the burner is not fired).

Figure 9:
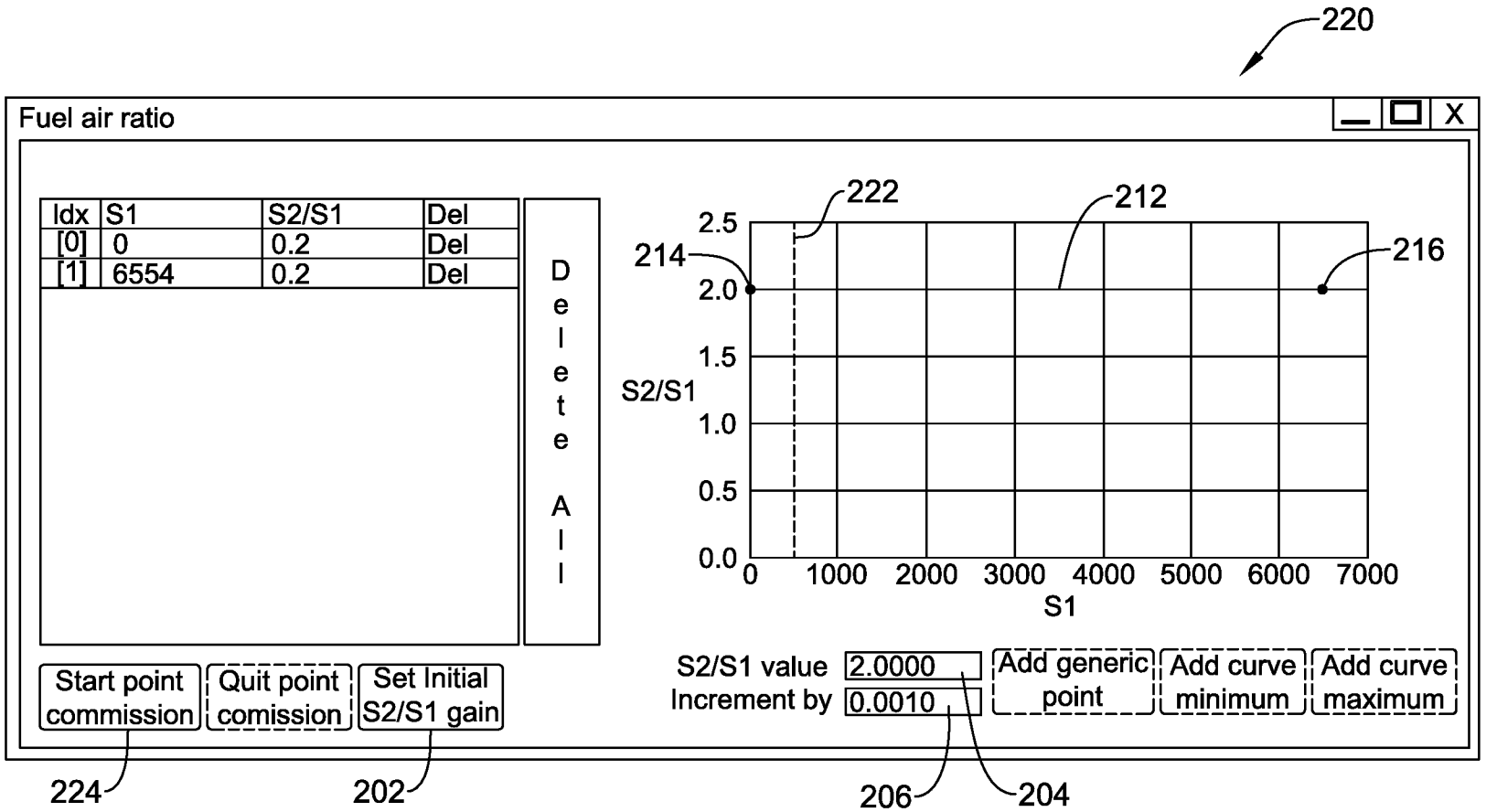

Once the burner is fired, the user can define custom curve points including curve minimum and curve maximum. This may be done by the user first setting the system to a desired burner load, as shown at block 112. This may be done completely independent of the external device 40 and the valve controller 26. While the valve controller 26 may continuously monitor a burner load via a burner load signal or command provided by the combustion appliance, the valve controller 26 may not set the burner load of the combustion appliance. FIG. 9 illustrates a screenshot 220 of the wizard after the user has set the combustion appliance to the desired burner load. In FIG. 9, the burner load is set to a value of 500, as illustrated by vertical dashed line 222. It should be noted that the installer may select any burner load desired.

Once the desired burner load is set, and the burner is operating at the burner load, the user may start "point commissioning", as shown at block 114. During point commissioning, the external device 40 sends an appropriate command to the valve controller 26 to indicate that the user wants to add a new point to the A/F ratio versus burner load curve. The command may be initiated by selecting a start point commission button 224 on the wizard. It should be noted that in prior steps, the "start point commission" button 224 was grayed out as a banned action. The command to start "point commissioning" switches the valve controller to control the A/F ratio based on a custom A/F ratio 204 ("S2/S1 value" in FIG. 9, as shown at block 116, which is defined by a user via the external device 40 (e.g. Modbus command) rather than based on the A/F curve 212. Curve point commissioning can be terminated by a user via an appropriate Modbus command (e.g. button selection via the external device 40).

To continue with point commissioning, as shown at block 118, the user may vary the A/F ratio 204 through the wizard, and the valve controller 26 may be configured to move at least one valve to control the flow of gas to the gas burner in accordance with the desired A/F ratio at the desired burner load. For example, a user may enter or input one or more, two or more, three or more, etc. A/F ratios for each burner load to determine an optimum or desired A/F ratio for that particular burner load. With each A/F ratio, the user may run or the combustion appliance and observe the operation of the combustion appliance to identify a desired A/F ratio for the current burner load. In some instances, the observation may include the use of a probe, or other device, to measure the combustion (e.g. emissions, temperature, color, etc.). After the user is satisfied with the combustion appliance performance and has identified an A/F ratio that provides the desired appliance performance, the user may save or store the new A/F point at the current burner load (e.g. store the desired A/F ratio and current burner load pair). It is contemplated that the user may enter as many A/F ratios as needed for a given burner load to arrive at the A/F ratio that produces the best combustion profile.

Figure 10:
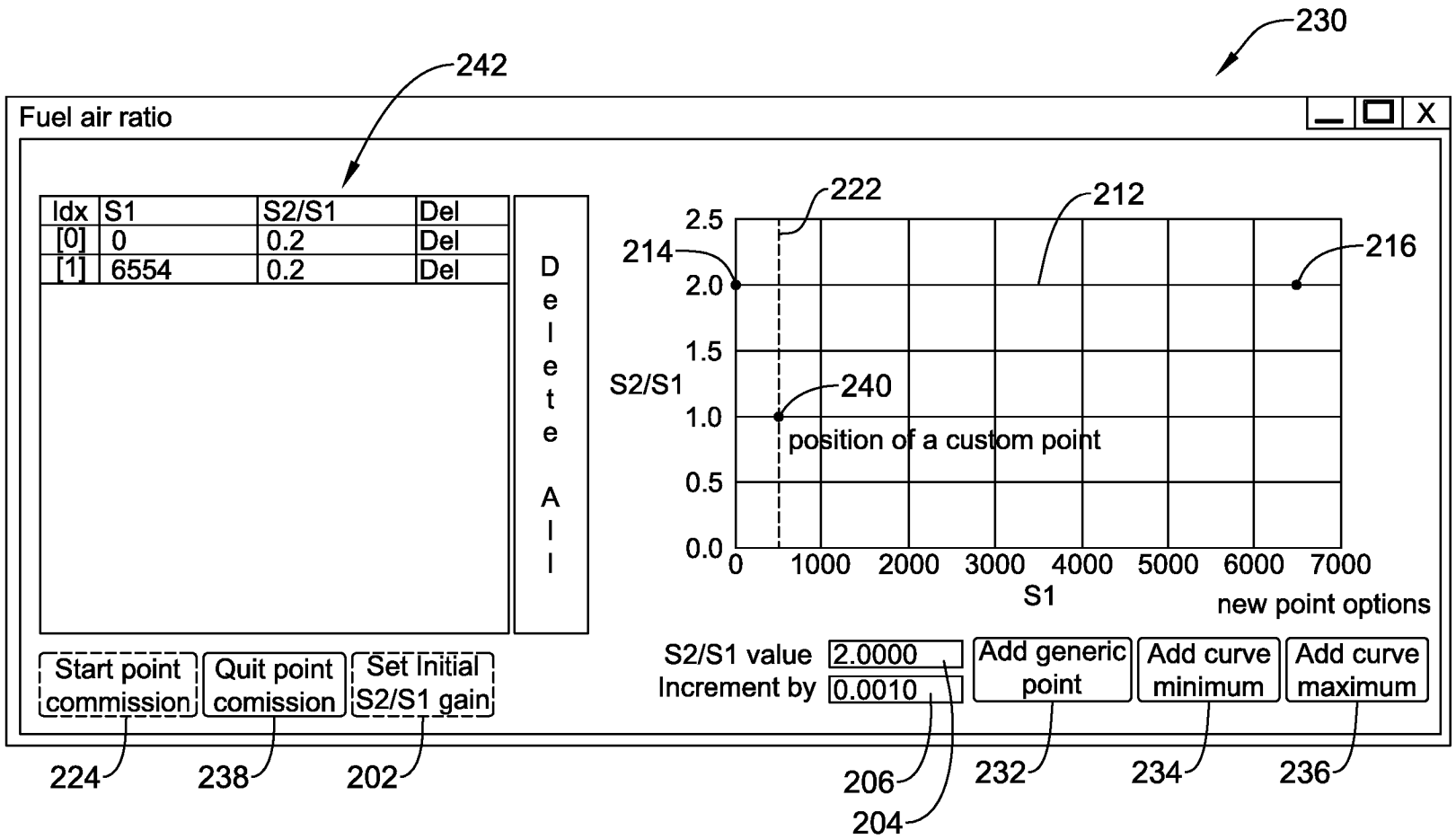

FIG. 10 illustrates a screenshot 230 of the illustrative wizard after a custom point has been entered at a burner load of "500". The user may store or save the custom point in the memory 30 of the valve controller 26, as shown at block 120, as a generic point 232, a minimum 234, or a maximum 236, by actuation of a corresponding button 232, 234, 236 of the wizard. The user may also quit the point commission procedure without storing or saving the custom A/F ratio 240 by actuating the quit point commission button 238, which was previously grayed out, as shown at block 130. When the point commission procedure is quit, the valve controller 36 automatically switches A/F control back to the A/F curve from custom A/F ratio, as shown at block 128. The user may need to restart the point commissioning procedure from the beginning, including setting the burner load (block 112), to commission a new point on the A/F curve. The user may also have the option of quitting the commissioning procedure without storing the custom A/F ratio 240 by sending the appropriate command (e.g. actuating the appropriate quit commission button), as shown at block 132. When the commission procedure is quit, the valve controller 36 may terminate the commissioning mode and enter an operational mode, as shown at block 134. If there are any errors in the commissioning procedure (e.g. missing A/F curve minimum/maximum, etc.) upon quitting commissioning, the valve controller 26 may lock out and prevent opening of the valve until the error is rectified.

Figure 11:
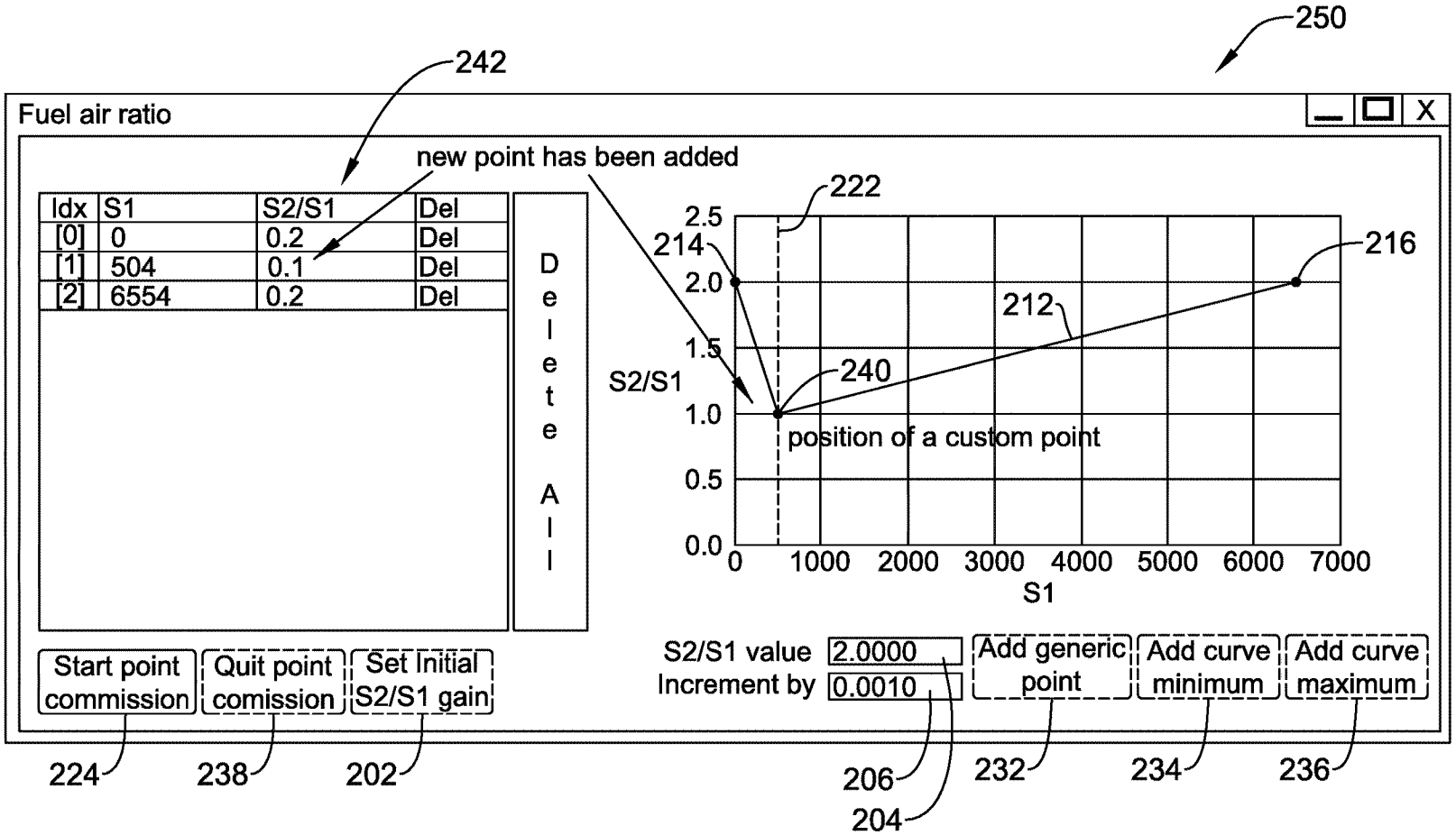

Prior to storing the custom point, the valve controller 26 may read an air flow sensor associated with the set burner load to verify that the air flow matches the set burner load if a source of burner load information is available (e.g. a communication from a burner controller), as shown at block 122. Alternatively, the burner load may be verified by measuring the burner load S1. The valve controller 26 may read the custom ratio register 242, as shown at block 124, and save or store the custom point to memory 30, as shown at block 126. When a new custom point (such as point 240) is stored, it redefines the curve and the valve controller 36 automatically switches A/F control back to the A/F curve from the custom A/F ratio, as shown at block 128. That is, and in some cases, the user needs to begin point commissioning from the beginning, including setting the burner load (block 112), to commission a new point on the A/F curve. FIG. 11 illustrates a screenshot 250 of the illustrative wizard after custom point 240 of FIG. 10 has been saved. As can be seen in FIG. 11, the A/F curve 212 has been redefined to account for the new custom point 240. The new custom point 240 is also stored in the custom ratio register 242. The user may repeat the steps outlined in blocks 112, 114, 116, 118, 120, and 128 until a user defines a plurality of A/F curve points over part or the whole expected working range (e.g. a plurality of burner loads between and sometimes including the minimum and maximum burner loads) of the combustion appliance. Once the A/F ratio curve has been defined by the user, the valve controller 26 may be configured to receive a desired burner load as an input (sometimes from a controller of the combustion appliance), and to move the at least one valve to control the flow of gas to the burner in accordance with the A/F ratio curve at the desired burner load.

Prior to terminating the commissioning process, a minimum and maximum of A/F curve may need to be defined. In other words, custom A/F points may be defined for the minimum burner load and the maximum burner load. The minimum and maximum of the A/F curve may be defined the same way as a generic curve point discussed above. However, the minimum and maximum of A/F curve may use separate commands (e.g. buttons 234, 236) to store these values. In some cases, if no minimum/maximum is entered by the user, the valve controller 26 may enter the lockout mode when the commissioning process is terminated by the user.

As described above, a software program, or wizard, may be used to facilitate the commissioning of the A/F curve for a particular valve assembly 10 and burner set-up. Further details of the wizard will be described with respect to FIGS. 12-14. In some cases, the A/F curve module (e.g. external device 40) may include a Modbus interface with a set of Modbus registers, a software module that handles the A/F ratio curve itself (e.g. sorts its points, inserts a new point, deletes an existing point, etc.), and a state machine that makes sure a user performs only operations that are permitted at a given point in the commissioning process. The A/F curve module may provide an interface to the curve (e.g. a set of operations that can be performed on the curve). For example, the A/F curve module may provide an interface for: initial A/F ratio related operations (e.g. set a gain, get a gain, etc.), minimum and maximum set points (e.g. setting, clearing and obtaining their values), generic points (e.g. setting, clearing and obtaining their values), clearing an entire A/F curve, etc.

The Modbus interface may include a set of registers. A first register may be used for A/F curve points. In some cases, there are 25 Modbus register pairs (for 25 points). However, this is just an example. It is contemplated that the registers may include fewer than 25 or greater than 25 Modbus register pairs, as desired. It should be noted that not all of the register pairs need to be actually used—for example, if an A/F curve only has 3 defined points it would be mapped to the first 3 Modbus register pairs and the rest would remain empty. Each register pair may include an Air/Fuel ratio and a corresponding burner load. In some cases, the registers can't be modified directly (with an exception, which is described below), but rather only indirectly via an Air/Fuel ratio register, Command register and Single curve point operation register. This way, controller is able to sort curve points and safely control a user access to the A/F curve. Registers can be modified directly when the A/F curve gets locked by a user when operating in a special installer mode. When the A/F ratio curve is locked, other curve operations are banned and the controller allows unrestricted write access to all curve registers to allow for storing the whole curve at once. This could be useful when copying settings of an identical system.

The Modbus interface may also include an Air/Fuel ratio register which may be a read-write register. The user may store a new curve point or an initial curve point via the Air/Fuel ratio register. The Air/Fuel ratio register may be used together with the Command register. The Command register may also be a read-write register. Writing a command into the Command register triggers appropriate action (if permitted), such as, but not limited to, delete a point, store new point, delete whole curve, etc. Commands may be mapped to A/F curve state machine events.

The Modbus interface may also include a single curve point operation register. The single curve point operation register may be a read-write register. Content of the single curve point operation register may be used as an identifier (index) of a curve point. When a single point operation is triggered by writing a command into the Command register, the controller may perform the operation on the point given by Single curve point operation register.

The Modbus interface may also include an available actions register. This may be a read-only register. Each bit of the available actions register may correspond to a single command. Bits are set based on the current commissioning state (e.g., based on current state of the state machine). This way, the user may be informed on available actions that can be taken to help guided the user throughout the commissioning process.

The Modbus interface may also include a current Air/Fuel ratio register. This may be a read-only register. The current Air/Fuel ratio register may contain the current Air/Fuel ratio as evaluated based on an Air/Fuel curve and the current burner load. It may indicate a current position of the Air/Fuel control process on the Air/Fuel curve.

The Modbus interface may also include an Air/Fuel curve flags register. This may be a read-only register containing flags with various meaning to give a user more information about ongoing commissioning process.

The state machine may handle the commissioning process. It may help make sure that the commissioning is performed in the required order (as outlined with respect to FIGS. 6-11), that commissioning is banned when it should not be performed (e.g. gas valves are OFF, A/F hardware components are not connected, etc.). The state machine may also help ensure that the valve controller does not hang in commissioning by, for example, limit the commissioning time (e.g. by providing a watchdog timer function). Based on a current commissioning state, allowed actions are set to guide a user through the commissioning process. The notation of the state machine may comply with UML standards. There are states, events, transitions and actions (entry, exit, transition). The state machine may be hierarchical and allow for state nesting. The state machine may include three machines or modules: an A/F curve machine, a commissioning sub-machine and a ready-for-point sub-machine.

Figure 12:
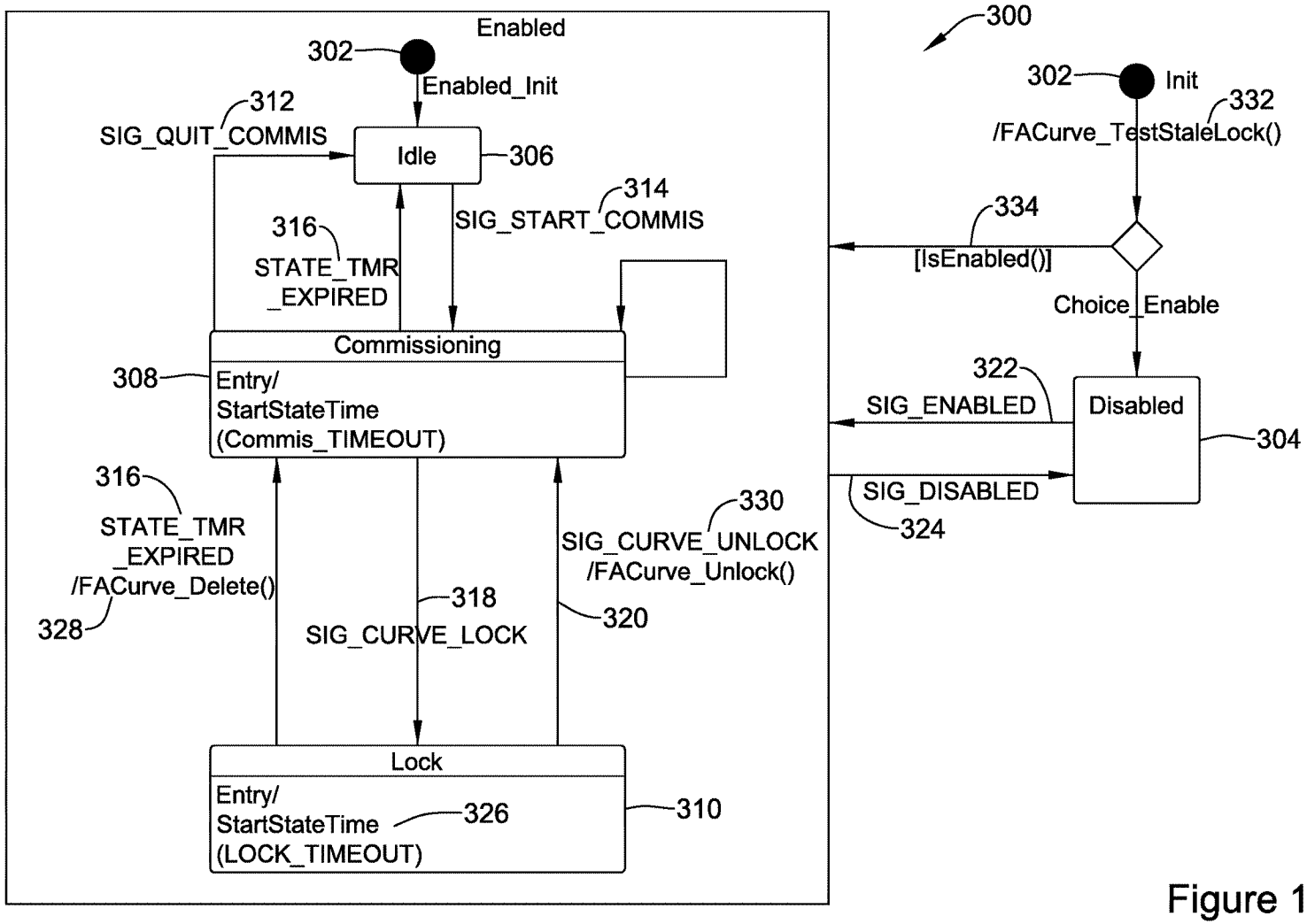
FIG. 12 is a schematic diagram of an illustrative A/F curve state machine.

The A/F curve machine may be a high level commissioning machine. It may disable commissioning when needed (e.g. A/F hardware is not connected). For example, the A/F curve machine may either put the commissioning into idle or further proceeds with commissioning based on a commissioning request. It may also lock the A/F curve to be written at one time. FIG. 12 illustrates an example A/F curve machine 300. The A/F curve machine 300 may include a plurality of states, including, but not limited to: enabled 302 (in which commissioning is enabled), disabled 304 (in which commissioning is disabled), idle 306 (in which there is no commissioning request pending), commissioning 308 (in which commissioning is in progress), and lock 310 (in which the A/F curve is locked for editing). The A/F curve machine 300 may also include a plurality of events, signals, and/or triggers. For example, events may include, but are not limited to: a user has quit the commissioning 312, a user has started a commissioning 314, state time has expired 316, a user has locked the curve for editing 318, a user has unlocked the curve for editing 320, commissioning is enabled (the A/F module is connected and control is in the special installer mode) 322, and commissioning is disabled 324. The A/F curve machine 300 may also include a plurality of actions. For example, actions may include, but are not limited to: starting a state timer 326, deleting a whole A/F curve 328, unlocking a whole A/F curve 330, and testing if the A/F curve had been locked by a prior power cycle but has not been unlocked 332. The A/F curve machine 300 may also include one or more guards. An illustrative guard 334 may return true if commissioning is enable (the A/F module is connected and control is in the special installer mode).

Figure 13:
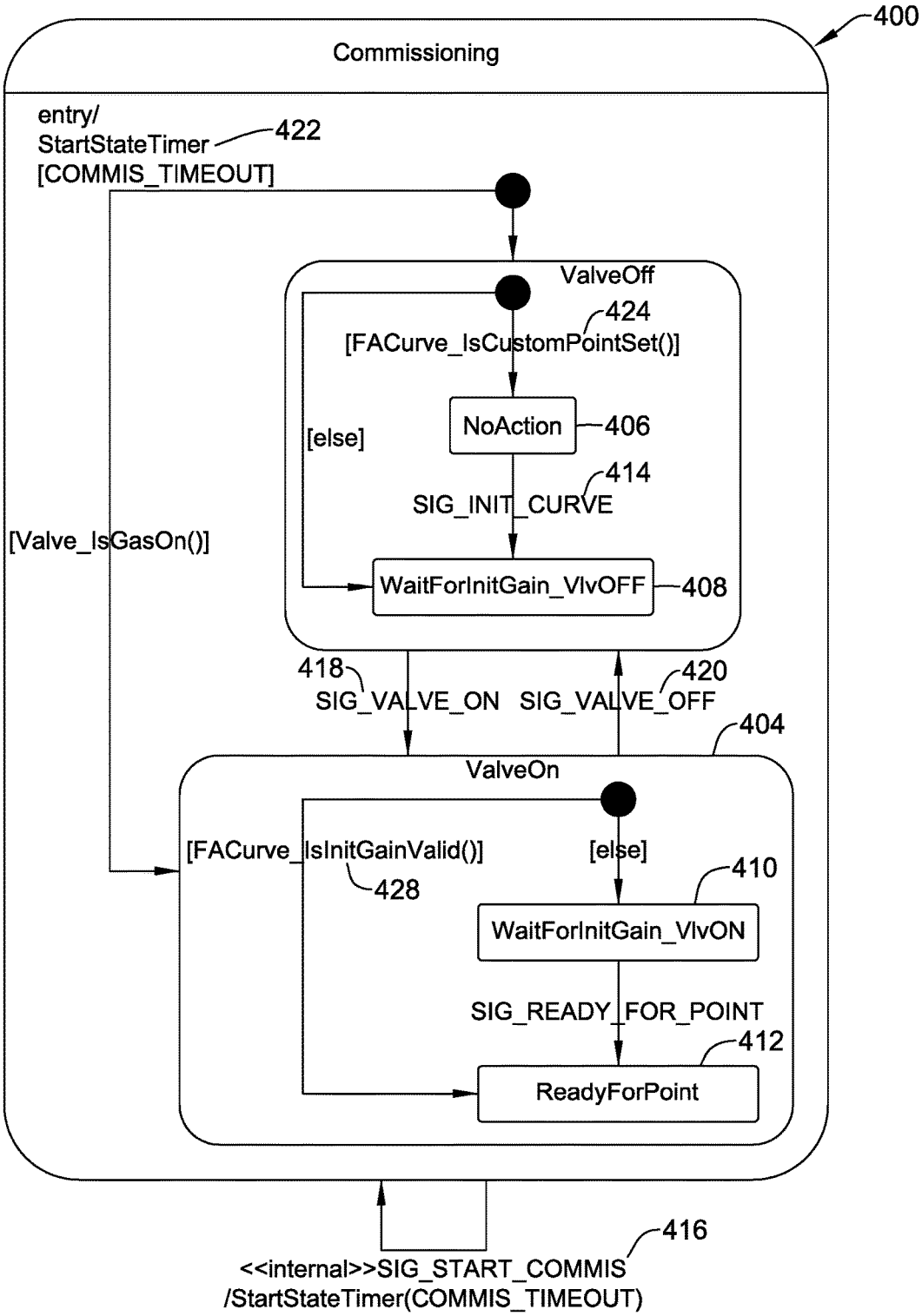
FIG. 13 is a schematic diagram showing more detail of the Commissioning block of FIG. 12.

The commissioning sub-machine may be one of A/F curve machine states 308. It controls actual commissioning of A/F curve points and initial curve A/F ratio. When the gas valve is closed, an initial A/F ratio is allowed to be modified/set. When the gas valve opens and the initial A/F ratio has already been set, a user can set additional custom A/F curve points. The user may need to periodically request commissioning otherwise commissioning is quit. This ensures that commissioning is terminated even though the user fails to explicitly quit the process. FIG. 13 illustrates an example commissioning sub-machine 400. The commissioning sub-machine 400 may include a plurality of states, including, but not limited to: ValveOFF 402 (in which the gas valve is closed), ValveON 404 (in which the gas valve is opened), NoAction 406 (there is nothing to do, valve is OFF and a curve already contains custom points. Therefore it's not possible to set an initial A/F ratio), WaitForInitGain_VIvOFF 408 (Gas valve is OFF and controller is ready to receive an initial A/F ratio), WaitForInitGain_VIvON 410 (Gas valve is opened. Controller waits for an initial A/F ratio—A/F curve is empty.), and ReadyForPoint 412 (Controller is ready to receive a custom A/F curve point, i.e. an initial A/F ratio has already been set (and possibly some custom points)). The commissioning sub-machine 400 may also include a plurality of events, signals, and/or triggers. For example, events may include, but are not limited to: indicating that the A/F curve is either empty or contains just two points that have been generated from an initial A/F ratio 414 (in other words there has not been a custom A/F curve point set yet), a user has started a commissioning 416, a gas valve has been opened 418, and a gas valve has been closed 420. The commissioning sub-machine 400 may also include a one or more actions. For example, actions may include, but are not limited to: starting a state timer 422. The commissioning sub-machine 400 may also include a plurality of guards. For example, guards may include, but are not limited to: returning true if A/F curve contains a custom point 424 (e.g. it is neither blank nor it contains just an initial A/F ratio), returning true if the gas valve is opened 426, and returning true if current initial curve A/F ratio is within limits 428.

Figure 14:
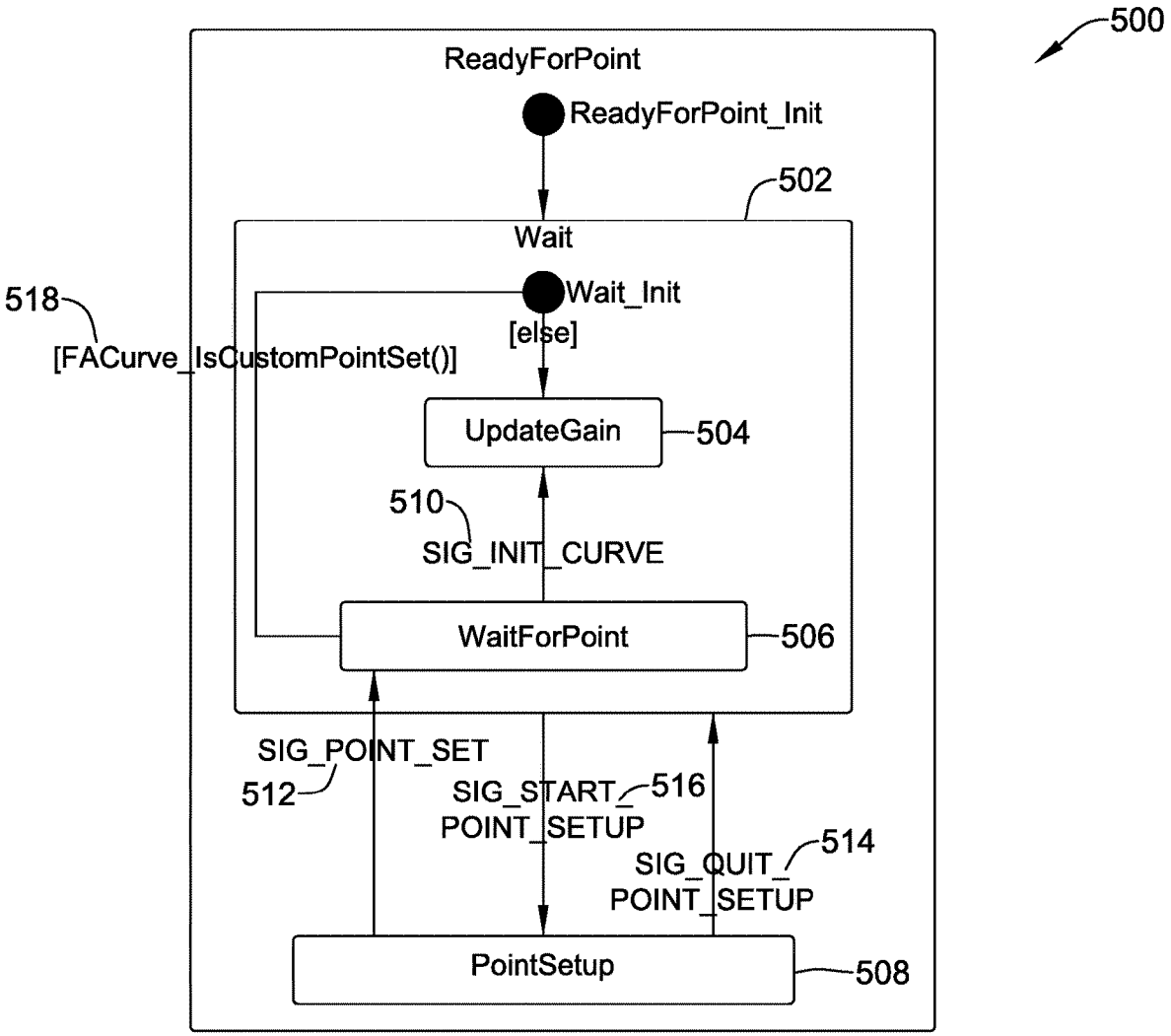
FIG. 14 is a schematic diagram showing more detail of the ReadyForPoint block of FIG. 13.

The Ready-for-point sub-machine is one of the commissioning sub-machine states 412. It performs commissioning of an A/F single point or of an initial curve A/F ratio if no custom point has been set so far. FIG. 14 illustrates an example Ready-for-point sub-machine 500. The Ready-for-point sub-machine 500 may include a plurality of states, including, but not limited to: wait 502 (waiting for a user request to start point commissioning), UpdateGain 504 (A/F curve has no custom point—an initial A/F ratio can be set), WaitForPoint 506 (A/F curve already contains a custom point; controller is waiting for user request to start a custom point commissioning), and PointSetup 508 (a user is setting a new A/F curve point). The Ready-for-point sub-machine 500 may also include a plurality of events, signals, and/or triggers. For example, events may include, but are not limited to: indicating that the A/F curve is either empty or contains just two points that have were determined from an initial A/F ratio 510, a curve point has been stored 512, a user has terminated curve point commissioning 514, and a user has started curve point commissioning 516. The Ready-for-point sub-machine 500 may also include one or more guards. An illustrative guard 518 may return true if A/F curve contains at least one custom point.

It should be understood that this disclosure is, in many respects, only illustrative. The various individual elements discussed above may be arranged or configured in any combination thereof without exceeding the scope of the disclosure. Changes may be made in details, particularly in matters of shape, size, and arrangement of steps without exceeding the scope of the disclosure. The disclosure's scope is, of course, defined in the language in which the appended claims are expressed.

What is claimed is:

1. A method for commissioning a gas valve assembly for controlling fuel flow to a combustion appliance, the method comprising:

including a valve body with an inlet port and an outlet port in the gas valve assembly, and extending a fluid path between the inlet port and the outlet port, the gas valve assembly further including at least one valve situated in the fluid path between the inlet port and the outlet port, the gas valve assembly further including a controller secured relative to the valve body and in communication with the at least one valve, the controller configured to move the at least one valve between an open configuration, a closed configuration, and a plurality of intermediate configurations therebetween to control a flow of gas to a gas burner of the combustion appliance, the method further comprising:

initiating, by an external device via a wireless or wired connection, a commissioning mode in the controller of the gas valve assembly;

once in the commissioning mode using a wizard screen in the external device:

inputting a user defined initial air to fuel (A/F) ratio;

activating the combustion appliance to start heating the gas burner;

setting a burner load of the combustion appliance to a set burner load;

inputting a desired A/F ratio for the set burner load;

running the combustion appliance at the burner load with the desired A/F ratio, and observing the operation of the combustion appliance;

saving the desired A/F ratio for the set burner load to the controller of the gas valve assembly; and exiting the commissioning mode.

2. The method of claim 1, further comprising repeating the setting, inputting, running and saving steps for each of one or more different burner loads.

3. The method of claim 1, further comprises inputting two or more A/F ratios for the set burner load, and identifying which of the two or more A/F ratios is the desired A/F ratio when observing the operation of the combustion appliance.

4. The method of claim 3, wherein the observing the operation of the combustion appliance comprises sensing combustion using one or more combustion sensors.

5. The method of claim 1, further comprising activating a commissioning wizard that guides a user in the inputting, activating, setting, inputting, running and saving steps.

6. The method of claim 1, wherein the controller of the gas valve assembly is configured to enter a lockout mode if the user defined initial A/F ratio is not defined.

7. The method of claim 1, wherein setting the burner load of the combustion appliance is performed at a user interface of the combustion appliance, which is a separate user interface from a user interface of the gas valve assembly.

8. The method of claim 1, wherein entering the commissioning mode switches A/F ratio control of the gas valve assembly from a stored A/F ratio curve to a custom user defined ratio.

9. The method of claim 8, wherein exiting the commissioning mode switches A/F ratio control of the gas valve assembly from the custom user defined ratio to a stored A/F ratio curve.

10. A method for commissioning a gas valve assembly for controlling fuel flow to a combustion appliance, the method comprising:

including a valve body with an inlet port and an outlet port in the gas valve assembly, and extending a fluid path between the inlet port and the outlet port, the gas valve assembly further including at least one valve situated in the fluid path between the inlet port and the outlet port, the gas valve assembly further including a controller secured relative to the valve body and in communication with the at least one valve, the controller configured to move the at least one valve between an open configuration, a closed configuration, and a plurality of intermediate configurations therebetween to control a flow of gas to a gas burner of the combustion appliance, the method further comprising:

initiating, by an external device via a wireless or wired connection, a commissioning mode, using a wizard screen, in the controller of the gas valve assembly;

activating the combustion appliance to start heating the gas burner;

setting a burner load of the combustion appliance to a first set burner load;

entering two or more A/F ratios for the first set burner load;

running the combustion appliance at each of the entered A/F ratios at the first set burner load, and observing the operation of the combustion appliance to identify a desired A/F ratio for the first set burner load;

saving the desired A/F ratio for the first set burner load to the controller of the gas valve assembly; and repeating in order to save a plurality of desired A/F ratios one for each of a plurality of different burner loads that are between a minimum burner load and a maximum burner load of the combustion appliance.

11. The method of claim 10, further comprising:

providing a desired burner load to the gas valve assembly from a controller of the combustion appliance; and in response, the controller of the gas valve assembly is configured to move the at least one valve to control the flow of gas to the gas burner in accordance with the desired A/F ratio at the desired burner load stored in the controller of the gas valve assembly.

12. The method of claim 10, wherein the observing the operation of the combustion appliance comprises sensing combustion using one or more combustion sensors.

13. The method of claim 10, further comprising activating a commissioning wizard that guides the user in the entering, running, saving and repeating steps.

14. The method of claim 10, wherein setting the burner load of the combustion appliance is performed at a user interface of the combustion appliance, which is a separate user interface from a user interface of the gas valve assembly.

15. The method of claim 10, wherein the plurality of desired A/F ratios define an operating A/F ratio curve.

* * * * *